US008644538B2

(12) United States Patent
Pape et al.

(10) Patent No.: US 8,644,538 B2
(45) Date of Patent: Feb. 4, 2014

(54) METHOD FOR IMPROVING THE COMPREHENSIBILITY OF SPEECH WITH A HEARING AID, TOGETHER WITH A HEARING AID

(75) Inventors: Sebastian Pape, Erlangen (DE); Maja Serman, Erlangen-Buckenhof (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1 day.

(21) Appl. No.: 13/437,041

(22) Filed: Apr. 2, 2012

(65) Prior Publication Data

US 2012/0250917 A1 Oct. 4, 2012

(30) Foreign Application Priority Data

Mar. 31, 2011 (DE) ..... 10 2011 006 472

(51) Int. Cl.
*H04R 25/00* (2006.01)

(52) U.S. Cl.
USPC ..... 381/316; 381/312

(58) Field of Classification Search
USPC ..... 381/312–314, 316–317, 320–321
See application file for complete search history.

(56) References Cited

U.S. PATENT DOCUMENTS

| | | | | |
|---|---|---|---|---|
| 5,014,319 | A | 5/1991 | Leibman | |
| 5,204,906 | A | 4/1993 | Nohara et al. | |
| 6,236,731 | B1 * | 5/2001 | Brennan et al. | 381/316 |
| 2006/0253209 | A1 | 11/2006 | Hersbach et al. | |
| 2009/0112594 | A1 | 4/2009 | Kim et al. | |
| 2011/0150256 | A1 | 6/2011 | Baechler et al. | |

FOREIGN PATENT DOCUMENTS

| | | | |
|---|---|---|---|
| DE | 69105154 | T2 | 3/1995 |
| EP | 1441562 | A2 | 7/2004 |
| EP | 1686566 | A2 | 8/2006 |
| WO | 2009143898 | A1 | 12/2009 |

OTHER PUBLICATIONS

Munoz, et al: "Frequency Lowering Processing for Listeners with Significant Hearing Loss", 6th IEEE International Conference on Electronics, Circuits and Systems, XP-010361677, vol. 2, Sep. 5, 1999, pp. 741-744, Baltimore, Maryland.

* cited by examiner

*Primary Examiner* — Suhan Ni
(74) *Attorney, Agent, or Firm* — Laurence A. Greenberg; Werner H. Stemer; Ralph E. Locher

(57) ABSTRACT

The understanding of speech is to be improved in cases of hearing loss in which certain frequency ranges can no longer be perceived even at high volume or amplification, as applicable. A frequency transposition is performed on an input signal coming into a hearing aid and specific features of an electrical input signal are detected and a transposed signal is filtered as a function of the specific features detected in the electrical input signal. The hearing aid provides appropriate facilities for detecting specific features of the electrical input signal and filtering facilities for filtering the transposed signal. The objective of this is to detect particular properties of the input signal, in particular signal properties which are characteristic of fricatives, which may possibly be lost as a result of the frequency transposition, and at least partially to restore them in the transposed signal.

18 Claims, 3 Drawing Sheets

METHOD FOR IMPROVING THE COMPREHENSIBILITY OF SPEECH WITH A HEARING AID, TOGETHER WITH A HEARING AID

CROSS-REFERENCE TO RELATED APPLICATION

This application claims the priority, under 35 U.S.C. §119, of German application DE 10 2011 006 472.9, filed Mar. 31, 2011; the prior application is herewith incorporated by reference in its entirety.

BACKGROUND OF THE INVENTION

1. Field of the Invention

The invention relates to a hearing aid together with a method for operating a hearing aid with an input transducer for receiving an input signal and converting it into an electrical input signal, a signal processing unit for processing the electrical input signal and effecting frequency-dependent amplification of it, and for generating an electrical output signal, and an output transducer for converting the electrical output signal into an output signal which the user can perceive as an acoustic output signal.

Due to the required small size of the devices and the small distance between the input transducer (in particular a microphone) and the output transducer (in particular an earpiece), the maximum amplification which can be achieved with a hearing aid is generally subject to narrow limits. In particular, if the amplification is too high an extremely disturbing feedback whistle arises. The feedback susceptibility of a hearing aid is frequency-dependent, and mostly affects the upper end of the frequency range which a hearing aid can transmit.

For many of those with damaged hearing, the problem thus arises that even when they are equipped with a hearing aid they can no longer adequately perceive certain frequency ranges. In the perception of speech this leads to certain sounds not being correctly understood, in particular consonants which in terms of speech have signal components which are in the high frequency signal spectrum. This particularly affects the so-called fricatives, which are named after the way they are articulated, for example "s", "sh", "v" or "z".

A known way of compensating for the loss of hearing described is to transpose the frequency ranges affected into other frequency ranges, which can be better perceived. In performing a frequency transposition of this type, two main methods are distinguished: in the case of frequency displacement, a frequency range (e.g. 4 kHz-6 kHz) is shifted into another frequency range (e.g. 2 KHz-4 kHz). In contrast to this, in the case of frequency compression the frequency of the output signal is produced by multiplying the frequency of the input signal by a factor (e.g. 0.75). Often however, frequency compression is not effected with 0 Hz as the starting point, but only above a certain frequency (the knee point) e.g. 2 kHz.

Methods for frequency transposition in a hearing aid, and a hearing aid for carrying out a frequency transposition, are known from the publication, European patent application EP 1 441 562 A2.

Frequency transposition, in particular frequency shifting, has two main disadvantages: on the one hand in respect of the spectrum, corruption of the original spectral composition of certain consonants and other sounds and, on the other hand, the ability to distinguish different fricatives—which affects their perception—is significantly impaired.

From the prior art, methods of speech signal processing are known by which the vowels or consonants can be recognized in a voice signal. For example, German utility model DE 691 05 154 T2 discloses a method of this type with which a voice signal spectrum is analyzed for the purpose of determining peak and average values, which are compared with certain threshold values to recognize vowels and consonants.

Also, a method is known from U.S. patent publication No. 2009/0112594 A1 whereby pre-vowel consonants and post-vowel consonants are distinguished on the basis of acoustic models.

U.S. Pat. No. 5,014,319 describes a hearing aid in which a frequency analysis device classifies sounds and, for a frequency transposition, determines a transposition factor appropriate for the frequencies occurring in the sounds. In order to avoid the frequency transposition suppressing individual speech sounds, so that useful information is then lost, a device for the reconstruction of speech components is provided in this hearing aid. For this purpose, the start of each individual speech sound which is recognized is stored, and the residue which remains is in each case discarded. The actual frequency transposition is then achieved by outputting these speech start-sounds over an extended time.

SUMMARY OF THE INVENTION

It is the objective of the present invention to improve the comprehension of speech in the case of a hearing loss where certain frequency ranges can no longer be perceived even at high volumes.

With the foregoing and other objects in view there is provided, in accordance with the invention a hearing aid. The hearing aid includes an input transducer for receiving an input signal and converting the input signal into an electrical input signal, a signal processing unit for processing and frequency-dependent amplification of the electrical input signal and for generating an electrical output signal, an output transducer for converting the electrical output signal into an output signal which can be perceived by a user as an acoustic output signal, facilities for performing a frequency transposition and for generating a transposed signal, facilities for detecting specific features of the electrical input signal, and filtering facilities, for filtering the transposed signal, whereby the filtering is performed in dependence on the specific features which have been detected in the electrical input signal.

A hearing aid in accordance with the invention is to be understood as any device which supplies an output signal which can be perceived by a user as an acoustic signal, or contributes to the supplying of such an output signal, and which provides facilities which act as or contribute towards compensation for an individual loss of hearing in the user. In particular, this will be a hearing aid which can be worn on, or can be wholly or partially implanted in, the body or the head, in particular on or in the ear. However, it also includes devices whose primary purpose is not to compensate for a hearing loss, for example electronic entertainment devices (TVs, hi-fi systems, MP3 players etc.), or communication devices (mobile telephones, PDAs, headsets etc.) which do however provide measures for compensating for an individual loss of hearing.

In general, a hearing aid incorporates an input transducer for receiving an input signal. The input transducer will, for example, be in the form of a microphone which receives an acoustic signal and converts it into an electrical input signal. However, it is also possible to regard as the input transducer units which have a coil or an antenna and which receive an electromagnetic signal and convert it into an electrical input signal. Furthermore, a hearing aid conventionally incorporates a signal processing unit for processing and effecting frequency-dependent amplification of the electrical input signal. For the purpose of signal processing in the hearing aid, use will be made of a signal processor, preferably digital (a DSP), whose method of working can be influenced by programs or parameters which can be transmitted to the hearing aid. This enables the signal processing unit's way of working to be adapted, both for the individual loss of hearing of a hearing aid wearer and also for the current hearing situation in which the hearing aid is currently being operated. The electrical input signal which has been modified in this way is finally fed to an output transducer. This is generally in the form of an earpiece which converts the electrical output signal to an acoustic signal. However, here again other forms of embodiment are possible, e.g. an implantable output transducer which is directly linked to the auditory ossicles and which excites vibrations in them.

The basic idea of the invention consists in detecting specific features of the electrical input signal and in filtering the transposed signal as a function of the specific features detected in the input signal. For this purpose, the inventive hearing aid provides appropriate facilities for detecting specific features of the electrical input signal, and filtering facilities for the purpose of filtering the transposed signal. The objective of this is to detect certain characteristics of the input signal which could be lost due to the frequency transposition and to restore them, at least partially, in the transposed signal.

In the case of one preferred form of embodiment, the specific features of the electrical input signal which are detected are, in particular, characteristic features of a speech signal which the input signal includes. These are, in particular, characteristic features of certain speech components, such as for example characteristic features of certain sounds, consonants or fricatives. In addition, however, it is possible to detect specific features of other signals included in the input signal, for example of music, and for filtering to be effected as a function of these features. Quite generally, the objective of the invention is retrospectively to retrieve, at least partially, features of the input signal which are specific, i.e. particular or characteristic, which are lost as a result of the frequency transposition, by filtering facilities.

In the case of one form of embodiment of the invention, the specific feature of an electrical input signal, in particular of a speech signal included in the electrical input signal, which is detected is the distribution of the input signal power against frequency. This can be based, for example, on a spectral analysis of the input signal, whereby the signal level is determined for each frequency in the input signal over a certain frequency range. The objective of the filtering of the transposed signal which follows is then to achieve a similar power distribution in the output signal, in which the corresponding power maxima and minima lie at an altered frequency, in accordance with a frequency transposition rule.

Another form of embodiment of the invention provides for the detection of the maxima and/or minima of the electrical input signal, as a function of the frequency, as its specific features. Here too, the number and positions of the maxima and minima are then mapped onto the transposed frequency range by appropriate setting of the filtering facilities.

The advantages of the invention are shown particularly clearly in the case of a hearing aid with filtering facilities for distributing the electrical input signal into several frequency bands (channels), in which the processing and the frequency-dependent amplification of the electrical input signal are effected at least partially in parallel in the individual frequency bands, and with facilities for the transference of at least one signal which is present in a first frequency band into a second frequency band in the course of the frequency transposition. In particular in the case of this channel-dependent or channel-by-channel frequency shift, as applicable, which in practice represents the method used for preference rather than frequency compression, the resulting power distribution or the distribution of the maxima and minima in the output signal, as appropriate, can deviate greatly from that of these variables in the original signal. As a result—if the invention is not used—when the input signal contains a speech signal the comprehension of this speech is in particular made significantly more difficult.

In the case of one particularly preferred form of embodiment of the invention, a hearing aid in accordance with the invention incorporates a sound detection device for the purpose of detecting specific features of the electrical input signal, by which sounds, in particular consonants or fricatives, can be recognized in the electrical input signal and the filtering can be effected as a function of a sound which has been recognized. The specific features of the electrical input signal which are detected in accordance with the invention are then characteristic features of these sounds, in particular a characteristic shape of the frequency spectrum, the power distribution etc.

In general terms, a sound is a noise or tone produced by a human or animal voice. In general speech science, a sound in the more narrow sense is a defined sound wave produced by a flow of breath (phonation airstream) with a particular adjustment of the speech organs. The generation and perception of sounds is the subject of phonetics. A speech sound, or phone, is here regarded as the smallest phonetic unit of spoken language.

In the sense of the invention, a consonant is to be understood generally as a sound, the articulation of which includes a narrowing of the vocal passage, so that the airstream from the breath is totally or partially blocked and audible turbulences (air eddies) are produced. Consonants are sounds which overcome a hindrance. In particular, in the sense of the invention consonants are not restricted to the consonant letters (B, C, D, F etc.).

Because the invention is intended, in particular, to contribute to improving the comprehensibility of speech, it is possible to restrict the application of the invention to periods of time in which there is a speech signal. The invention then detects the spectral power distribution of a recognized sound, or the distribution of the maxima and minima in the signal level, as applicable, and maps this onto the appropriate distribution in the transposed signal.

With one preferred form of embodiment of the invention, the inventive hearing aid incorporates facilities for the transformation of the input signal, or of a signal derived from this, into the frequency domain, whereby the signal processing takes place at least partially in the frequency domain. In the frequency domain it is more easily possible, in particular, to recognize sounds, in particular consonants or fricatives, than when the signal processing is in the time domain. Also, some specific features of the input signal can be detected more easily in the frequency domain than in the time domain.

Further, with one preferred form of embodiment of the invention, the filtering facilities effect the filtering in the time domain. In particular, narrow-band filters at the end of the signal processing performed by a relevant hearing aid can contribute to the mapping of a spectral distribution characteristic of certain sounds or fricatives, as applicable, into the restricted frequency range of the output signal.

Other features which are considered as characteristic for the invention are set forth in the appended claims.

Although the invention is illustrated and described herein as embodied in a method for improving the comprehensibility of speech with a hearing aid, together with a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
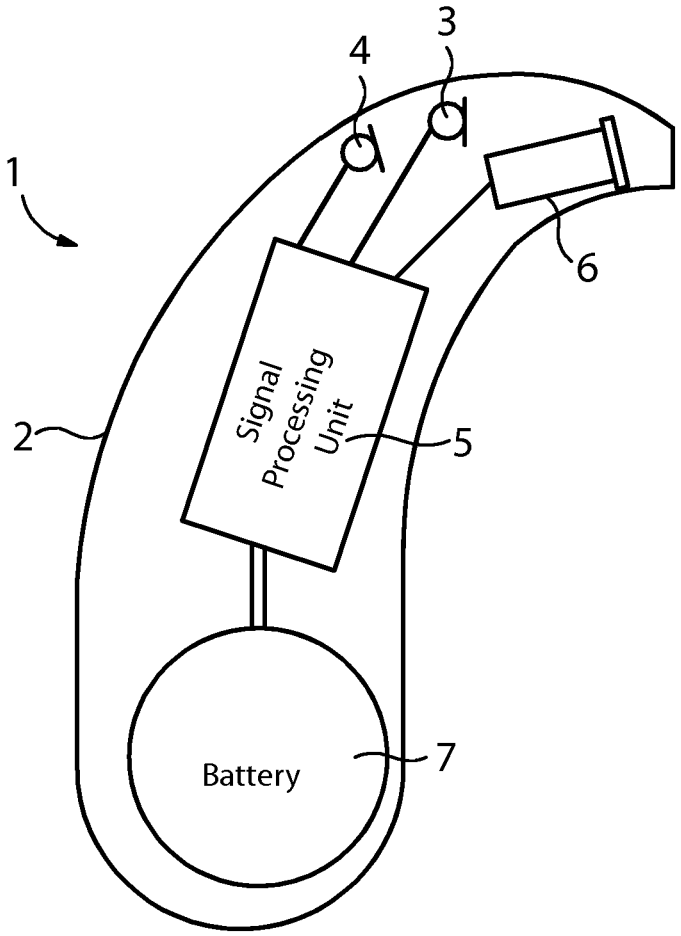
FIG 1 PRIOR ART
FIG. 1 is a simplified block diagram of a hearing aid in accordance with the prior art.

Referring now to the figures of the drawing in detail and first, particularly, to FIG. 1 thereof, there is shown a greatly simplified block diagram of a structure of a hearing aid in accordance with the prior art. In principle, hearing aids have as their essential components one or more input transducers, an amplifier and an output transducer. In general, the input transducer is a sound receiver, e.g. a microphone, or an electromagnetic receiver, e.g. an induction coil. The output transducer is mostly realized as an electro-acoustic transducer, e.g. a miniature loudspeaker or earpiece, as appropriate, or as an electro-mechanical transducer, e.g. a bone conduction earpiece. The amplifier is commonly integrated into a signal processing unit. This structural principle is illustrated in FIG. 1 by an example of a behind-the-ear hearing aid. Built into a hearing aid housing 2 which is to be worn behind the ear are two microphones 3 and 4 for the purpose of receiving the sound from the surroundings. A signal processing unit 5, which is also integrated into the hearing aid housing 2, processes the microphone signals and amplifies them. The output signal from the signal processing unit 5 is transmitted to a loudspeaker or earpiece 6, as applicable, which outputs an acoustic signal. If necessary, this sound is transmitted through a sound tube, which is fixed into the auditory canal using an otoplastic, to the eardrum of the hearing aid wearer. The power supply for the hearing aid, and in particular that for the signal processing unit 5, is effected by a battery 7 which is also integrated into the hearing aid housing 2.

Figure 2:
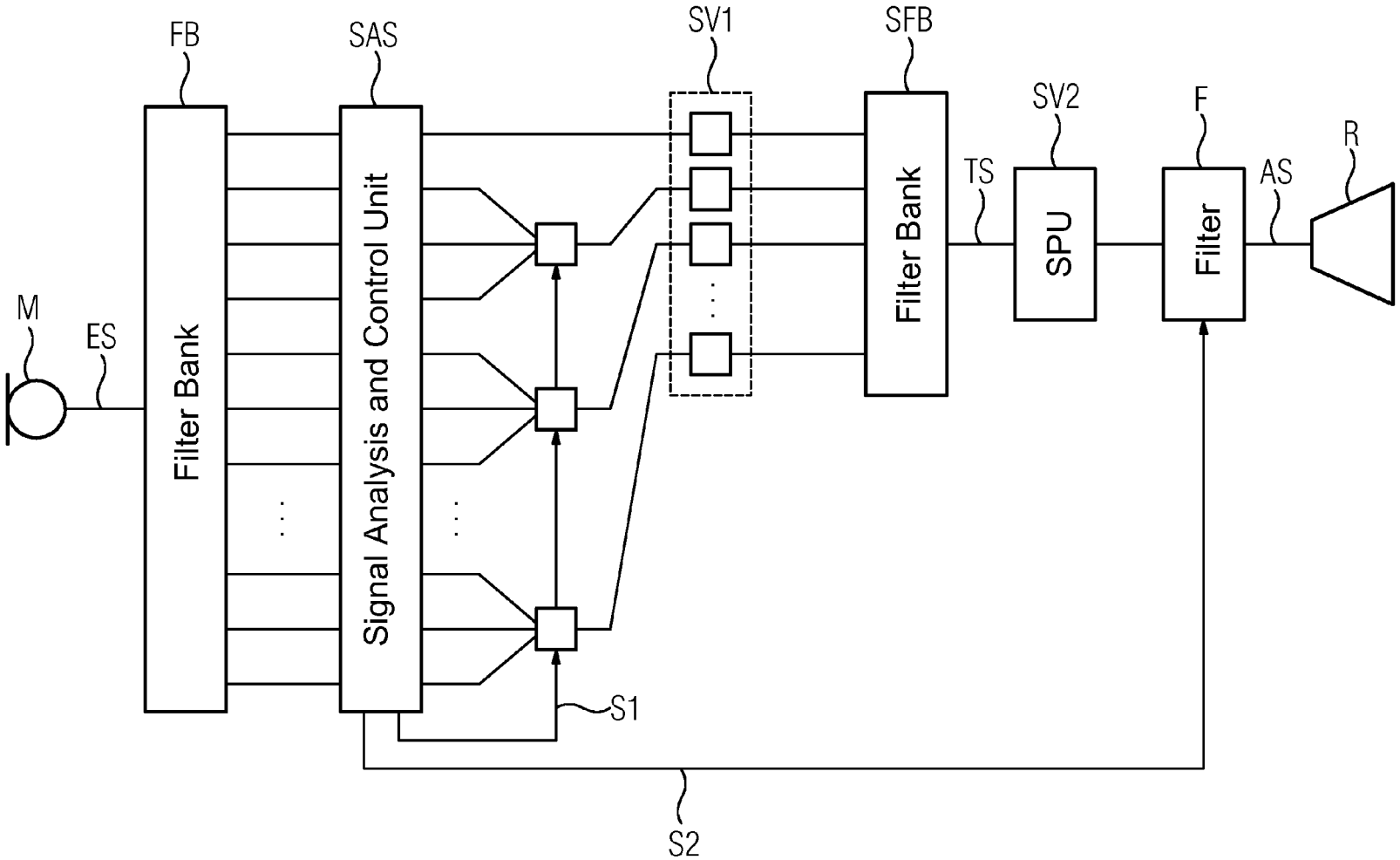
FIG. 2 is a block diagram of a hearing aid in accordance with the invention.

FIG. 2 shows a greatly simplified block diagram of a hearing aid in accordance with the invention. Here, a microphone M receives an acoustic input signal ES and converts this into an electrical input signal. The electrical input signal is first fed to a filter bank FB, in which the electrical input signal is split up into frequency bands (channels). Usually, the split is into between 3 and 16 frequency bands. However, a far greater number of frequency bands would be possible, or even a transformation into the so-called frequency domain.

The signals in the individual frequency bands are first fed to a signal analysis and control unit SAS for signal analysis. By means of the control signal 51, this unit controls the combination of each of several frequency bands into one frequency band, and the transposition of the resulting frequency band. In the exemplary embodiment, each of three output frequency bands are thereby mapped into one target frequency band. Following this, parallel processing of the transposed frequency bands is effected in a signal processing unit SV1, in particular for the purpose of compensating the individual loss of hearing of the user. The transposed frequency bands are combined together again in a synthesis filter bank SFB. In the simplest case, the synthesis filter bank SFB effects an addition of the signals in the individual transposed frequency bands. The result is the transposed output signal TS. If necessary, further signal processing is carried out, e.g. final amplification of the transposed output signal TS, in a further signal processing unit SV2. Finally, the resulting output signal AS is fed to an earpiece R, which converts the output signal into an acoustic output signal which is, if necessary, fed to the user's ear.

As shown in the exemplary embodiment, the signal analysis and control unit SAS of the hearing aid 11 incorporates in addition a sound detection device, by which sounds, in particular consonants, in particular fricatives, can be recognized in the electrical input signal ES by reference to their characteristic features. In particular, certain sounds are distinguished by a particular spectral power distribution or a particular relationship of the maxima and minima in their signal level as a function of the signal frequency. The signal analysis and control unit SAS recognizes in addition when the power distribution or relationship of the maxima and minima, as applicable, which is characteristic of a particular sound, is corrupted by the special frequency transposition. A control signal S2 is then generated and is fed to the adjustable filter F, so that the filtering effect of the filter controlled in this way produces an output signal AS with a spectrum which—apart from the transposition into another frequency range—is similar to the spectrum of the input signal ES. In particular, the number and sequence of the maxima and minima in the signal levels is restored.

In the exemplary embodiment, the generation of the control signal S2 can also be effected taking into account the transposed signal TS. For this purpose, the synthesis filter bank SFB is connected in an appropriate way to the signal analysis and control unit SAS. In particular, control of the filter F is effected on the basis of the result of a comparison of the input signal ES with the transposed signal TS in the signal analysis and control unit SAS.

Figure 3:
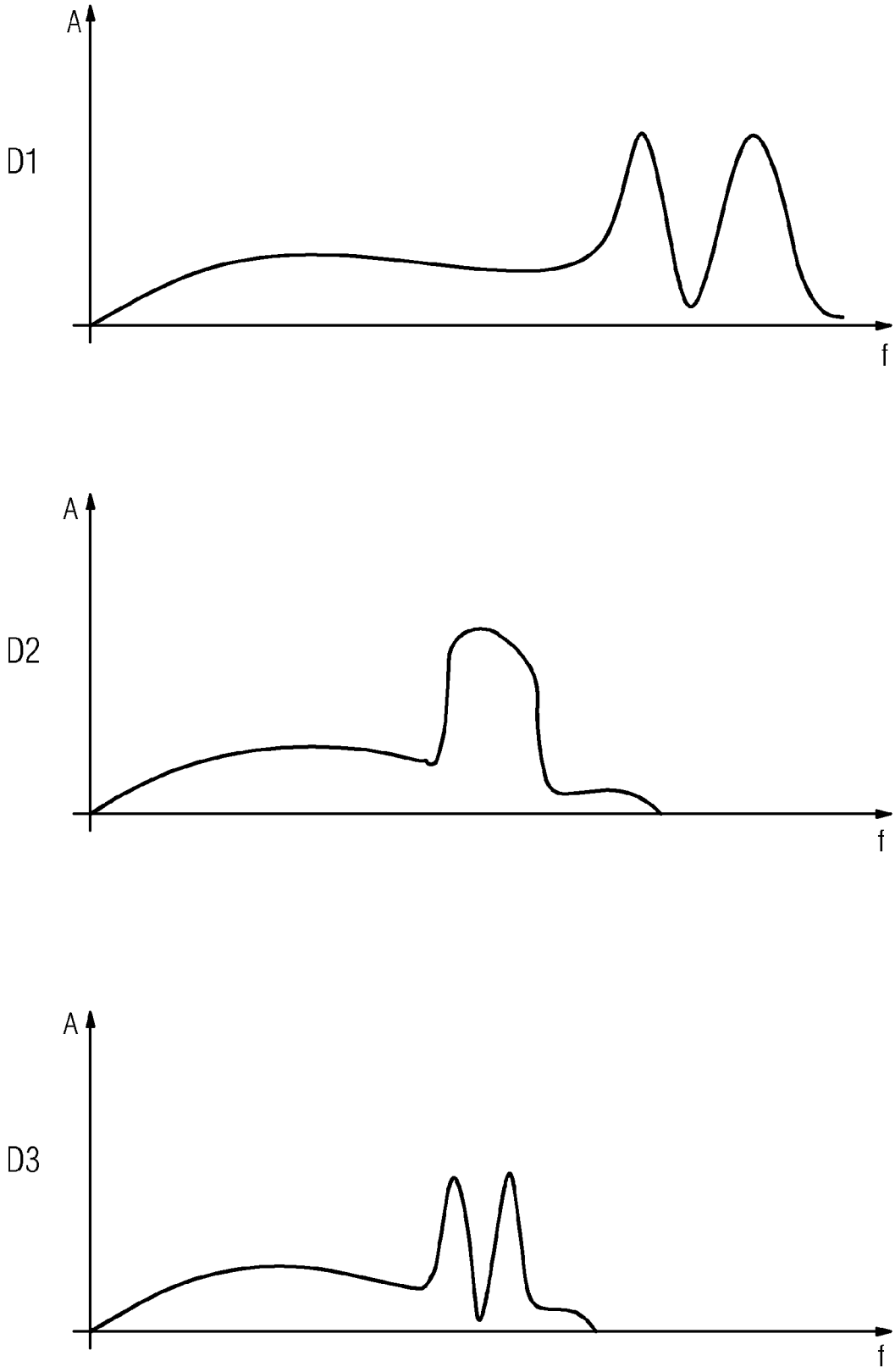
FIG. 3 is a diagram of graphs showing a spectrum of an input signal for a frequency transposition using the hearing aid in accordance with the invention.

FIG. 3 illustrates the signal formation in the case of the frequency transposition using the inventive hearing aid as shown in FIG. 2. First, a diagram D1 shows the spectrum of the input signal for a particular fricative, which is present in the input signal at a particular point in time. Because of a frequency transposition, whereby in each case several frequency bands are combined into one frequency band and are transposed, the characteristic form of this fricative in terms of the signal spectrum is lost. Diagram D2 then shows the spectrum of the fricative after the frequency transposition. However, by filtering of the transposed signal in accordance with the invention the characteristic form of the spectrum is largely restored. In the exemplary embodiment, this is effected in that the filter suppresses a certain frequency range in the transposed signal TS, so that once again the special characteristic form with two maxima and, lying between them, a minimum (see diagram D3) is produced. By this means, the acoustic impression of the fricative contained in the input signal is largely restored in the output signal.

The invention claimed is:

1. A hearing aid, comprising:

an input transducer for receiving an input signal and converting the input signal into an electrical input signal;

a signal processing unit for processing and frequency-dependent amplification of the electrical input signal and for generating an electrical output signal;

an output transducer for converting the electrical output signal into an output signal which can be perceived by a user as an acoustic output signal;

facilities for performing a frequency transposition and for generating a transposed signal;

facilities for detecting specific features of the electrical input signal; and filtering facilities, for filtering the transposed signal, whereby the filtering is performed in dependence on the specific features which have been detected in the electrical input signal.

2. The hearing aid according to claim 1, wherein said facilities for detecting are disposed for detecting a distribution of power of the electrical input signal against frequency.

3. The hearing aid according to claim 1, wherein said facilities for detecting are disposed for detecting at least one of a maxima or a minima of the electrical input signal in dependency on a frequency.

4. The hearing aid according to claim 1, further comprising:

further filtering facilities for splitting up the electrical input signal into several frequency bands, whereby processing and frequency-dependent amplification of the electrical input signal is effected at least partially in parallel in individual frequency bands; and facilities for transferring at least one signal which is present in a first frequency band into a second frequency band in a course of the frequency transposition.

5. The hearing aid according to claim 1, further comprising a sound detection device by means of which sounds in the electrical input signal, including consonants and fricatives, can be recognized, whereby the filtering is effected in dependence on characteristic features of a sound which has been recognized.

6. The hearing aid according to claim 5, wherein a recognition of the sounds is effected by detecting a distribution against frequency of maxima and minima in the electrical input signal and wherein said filtering facilities can be adjusted such that a distribution of maxima and minima in the electrical output signal is effected in dependence on the distribution of the maxima and minima in the electrical input signal.

7. The hearing aid according to claim 5, wherein an application of said filtering facilities can be limited in time and said filtering facilities can be applied for a duration of a sound which has been recognized.

8. The hearing aid according to claim 1, further comprising facilities for transformation of the input signal or of a signal derived therefrom into a frequency domain, wherein signal processing is effected at least partially in the frequency domain.

9. The hearing aid according to claim 1, wherein the filtering by said filtering facilities is effected in a time domain.

10. A method for operating a hearing aid, which comprises the method steps of:

receiving an input signal and converting the input signal into an electrical input signal;

processing and amplifying on a frequency-dependent basis the electrical input signal and generating an electrical output signal;

converting the electrical output signal into an output signal which can be perceived by a user as an acoustic output signal;

performing a frequency transposition and generating a transposed signal;

detecting specific features of the electrical input signal; and filtering the transposed signal in dependence on the specific features of the input signal which have been detected.

11. The method for operating the hearing aid according to claim 10, which further comprises detecting a power distribution of the electrical input signal against frequency.

12. The method for operating the hearing aid according to claim 10, which further comprises detecting at least one of a maxima or a minima of the electrical input signal in dependence on the frequency.

13. The method for operating the hearing aid according to claim 10, which further comprises:

splitting up the electrical input signal into several frequency bands and processing and amplifying the electrical input signal on a frequency-dependent basis at least partially in parallel in individual frequency bands; and transferring at least one signal which is present in a first frequency band into a second frequency band during the frequency transposition.

14. The method for operating the hearing aid according to claim 10, which further comprises recognizing sounds in the electrical input signal, including consonants or fricatives, and effecting the filtering in dependence on a sound which has been recognized.

15. The method for operating the hearing aid according to claim 14, which further comprises recognizing the sounds taking into account a distribution against frequency of maxima and minima in the electrical input signal, and the transposed signal is filtered such that a distribution of maxima and minima in the electrical output signal is effected in dependence on the distribution of the maxima and minima in the electrical input signal.

16. The method for operating the hearing aid according to claim 14, which further comprises limiting an application of filtering facilities time and the filtering is applied for a duration of a sound which has been recognized.

17. The method for operating the hearing aid according to claim 10, which further comprises transforming the input signal or a signal derived therefrom into a frequency domain and signal processing is effected at least partially in the frequency domain.

18. The method for operating the hearing aid according to claim 10, which further comprises effecting the filtering in a time domain.

* * * * *